United States Patent [19]

Baldenko et al.

[11] Patent Number: 4,764,094

[45] Date of Patent: Aug. 16, 1988

[54] SCREW MACHINE HAVING A PLURALITY OF SYMMETRICALLY ARRANGED ROTORS

[75] Inventors: Dmitry F. Baldenko; Jury V. Vadetsky; Moisei T. Gusman; Valery I. Semenets; Valentina A. Khabetskaya, all of Moscow, U.S.S.R.

[73] Assignee: Vsesojuzny Nauchno-Issledovatelsky Institut Burovoi Tekhniki, Moscow, U.S.S.R.

[21] Appl. No.: 35,731

[22] PCT Filed: Jul. 22, 1985

[86] PCT No.: PCT/SU85/00061

§ 371 Date: Mar. 20, 1987

§ 102(e) Date: Mar. 20, 1987

[87] PCT Pub. No.: WO87/00571

PCT Pub. Date: Jan. 29, 1987

[51] Int. Cl.[4] ..... F01C 1/107; F01C 11/00; F03C 2/08

[52] U.S. Cl. ..... 418/5; 418/48; 418/182

[58] Field of Search ..... 418/5, 48, 182; 175/107

[56] References Cited

U.S. PATENT DOCUMENTS 3,999,901 12/1976 Tschirky ..... 418/48
4,011,917 3/1977 Tiraspolsky et al. ..... 418/48

FOREIGN PATENT DOCUMENTS 286502 4/1969 U.S.S.R. .

OTHER PUBLICATIONS

"Downhole Screw Motors for Drilling Wells", Gusman and Baldenko et al., Nedra Publishers, Moscow, 1981.

"Screw Drilling Motors", Drilling Series, Moscow, 1972.

*Primary Examiner*—John J. Vrablik
*Assistant Examiner*—Leonard P. Walnoha
*Attorney, Agent, or Firm*—Burgess, Ryan & Wayne

[57] ABSTRACT

The screw machine comprises consecutively mounted screw mechanisms (6, 7 and 8, 9) incorporating coaxially arranged stators (10, 12 and 14, 16) and rotors (11, 13 and 15, 17) disposed therein whose axes are offset with respect to the central axis of the stators (10, 12 and 14, 16) by the amount of eccentricity "e" of the screw mechanisms (6, 7 and 8, 9). The screw mechanisms (6, 7 and 8, 9) are grouped into modules (4, and 5) and the modules proper are grouped into blocks (3). The axes of the rotors (11, 13, 15, 17) of the screw mechanisms (6, 7 and 8, 9) in the module (4 and 5) and the modules (4, and 5) proper in the block (3) are arranged symmetrically relative to the central axis.

3 Claims, 9 Drawing Sheets

SCREW MACHINE HAVING A PLURALITY OF SYMMETRICALLY ARRANGED ROTORS

TECHNICAL FIELD

The invention relates to power engineering and, more particularly, to screw machines.

PRIOR ART

Today, two basically different methods are used for drilling wells. The first one is a rotor method of drilling whereby the drive of a rock-breaking tool-bit is arranged on the surface and rotation to the bit is effected via a drill pipe string. The second method provides for the use of downhole motors as a drive which are disposed directly above the bit. The drill pipe string is stationary. The second method possesses a whole number of obvious advantages: no power is needed to rotate the drill pipe string, loads on drill pipes are diminished and, as a result, the number of failures in the borehole is decreased.

Among all types of downhole motors currently used in drilling wells, screw downhole motors are gaining a broad acceptance. These motors are simple to operate and service, have small overall dimensions, enable one to work with drilling muds of different density and viscosity (cf. M. T. Gusman, D. F. Baldenko et al. "Downhole Screw Motors for Drilling Wells", Nedra Publishers, Moscow, 1981).

In their typical design these motors contain a housing, an output shaft with radial and axial bearings and a screw mechanism which comprises a stator with internal screw teeth and a rotor disposed therein with external screw teeth. The stator is made in the form of a metal housing with an elastic lining vulcanized to its internal surface. In turn, the internal surface of the elastic lining has screw teeth. The number of the stator teeth exceeds by one that of the rotor teeth thereby ensuring, as the teeth interact, the division of the internal cavity of the screw mechanism into the working chambers—the cavities of high and low pressure. As the working agent is pumped through the screw mechanism, the working members begin to move relative to one another under the action of an arising pressure drop. In a typical most accepted design of the motor the stator is motionless and the rotor executes a planetary motion- the rotor axis describes a circumference around the stator axis and the rotor proper rotates about its own axis. This rotation is transmitted to the motor output shaft. By changing the number and the length of the pitch of screw teeth, one may obtain any necessary output characteristics of the motor. The latter is operated by the flow of the working agent which may be liquid (water or drilling mud), as well as aerated fluid or compressed air.

The major disadvantage of the aforelisted motors is a strong transverse vibration arising due to a specific motion of the screw mechanism rotor. Vibration causes a premature failure of the screw mechanism, the axial supports of the motor and may lead to a breakdown.

Also known in the art is a screw downhole motor, which comprises successively arranged screw mechanisms including coaxially disposed stators and rotors mounted therein whose axes are displaced relative to the axes of the stators to the value of eccentricity "e" of the screw mechanisms, as well as a spindle section (USSR Inventor's Certificate No. 286502, cl. F04 C5/00, 1969). This motor is basically the closest one to the present invention. In this design by way of calculations and selection of the lengths of coupling thread bushings, the axes of the rotors disposed in two adjacent stators of the screw mechanisms may be located in the same diameter to different sides from the axes of the stators. This assembly of the motor is fairly complicated and takes much time. Besides, an insignificant variation of the axial length of a group of rotors or stators with respect to each other upsets the position of the axes of the rotors relative to one another which is established during the assembly. A mere connection of one screw mechanism to another does not guarantee such an assembly. At the same time, the level of vibrations in the outlined construction does not decrease even in case of an optimal assembly because the forces of inertia and moments thereof affecting the motor are not balanced out.

DISCLOSURE OF THE INVENTION

This invention is aimed at solving the problem of providing such a screw machine the construction of which would allow of a substantial decrease in the impact of transverse vibrations on its units.

The problem set is solved owing to the fact that in a screw machine having successively disposed screw mechanisms which comprise coaxially arranged stators and rotors mounted therein whose axes are offset relative to the central axis of the stators by the amount of eccentricity "e" of the screw mechanisms, according to the invention, the screw mechanisms are grouped into modules and the modules proper are grouped into blocks, while the axes of the rotors of the screw mechanisms in the module and the modules proper in the block are arranged symmetrically relative to the central axis.

The disclosed construction of the screw machine makes it possible to substantially increase the service life of the machine and units thereof.

The service life is prolonged by reducing the effect of inertia and moments thereof causing vibration. The symmetrical position of the vectors of the forces of inertia about the central axis of the stators gives rise to the fact that the sum of all the forces of inertia acting in the machine is equal to zero. In most embodiments the symmetrical arrangement of the rotors serves to balance out the moments from said forces of inertia.

It is preferred that the distance between the axes of the rotors of the adjacent screw mechanisms be equal. This is accomplished by successive displacement of the axis of the rotor in each subsequent screw mechanism relative to the axis of the rotor of a preceding screw mechanism through a respective angle around the circumference of radius e equal to the eccentricity of screw mechanisms, with the centre coinciding with the central axis of the screw machine.

Such arrangement of the axis of rotors enables one to prolong still further the service life of the machine not only owing to the balancing of the forces of inertia, but also thanks to a complete balancing of moments thereof.

In a preferred embodiment of the invention provision is made for guide units adapted to ensure a preset relative displacement of the axes of the rotors and arranged in each block and in each module between the rotors of screw mechanisms. The availability of the guide units enables one to better preserve the preset orientation of the rotors of the screw mechanisms.

It is most expedient that each guide unit be made as a crank connected with the adjacent rotors by means of bearings, the axis of each bearing coinciding with that of a respective rotor. Such structural embodiment of the guide unit makes it possible to streamline the assembly of the screw machine.

The central angle of a symmetrical displacement of the axis of the rotor in each subsequent screw mechanism relative to the axis of the rotor in the preceding screw mechanism depends on the number of screw mechanisms in the module. Likewise, the angle of turn of one module with respecti to another depends upon the amount of modules in the block.

Depending on the number of screw mechanisms in each individual module, as well as depending on the number of individual modules in the block, one may substantially decrease, and in most variants of embodiment, completely balance the forces of inertia and moments thereof which helps reduce the level of vibration of stators thread bushings and other elements of the machine.

The reduction in the level of vibration of the screw machine improves the quality of a borehole drilling when using the screw machine as a downhole motor and stabilizes the operating conditions thereof.

The use of the guide units enhancing the reliability of orientation of the rotors in the screw mechanisms rules out the utilization of additional technological steps during the assembly of the motor which are necessary in case the guide units are not available.

The use of cranks as guide units substantially streamlines the assembly and cuts down the assembly time.

SUMMARY OF THE DRAWINGS

Other objects and advantages of the present invention will become more apparent upon considering the following detailed description of the exemplary embodiments thereof, with references to the accompanying drawings in which:

FIGS. 1, 1*a* is the general view of the screw downhole motor, longitudinal section;

BEST MODE FOR CARRYING OUT THE INVENTION

Figure 1A:
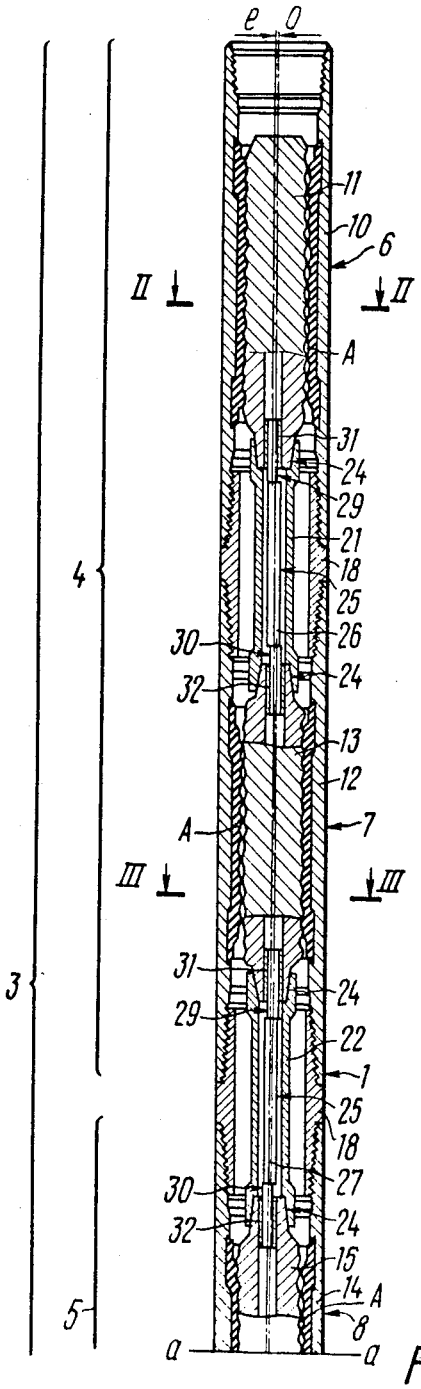

The screw machine in the variant of its embodiment as a downhole motor comprises an actuating mechanism 1 (FIG. 1*a*, 1*a) and a bearing unit 2. In the given structural embodiment the actuating mechanism 1 includes one block 3 which has modules 4 and 5. The amount of blocks 3** in the screw machine is determined by its output parameters (the torque, rotational speed, pressure drop) and, if necessary, may be increased.

The module 4 comprises two consecutively arranged screw mechanisms 6 and 7; the module 5 contains, respectively, screw mechanisms 8 and 9.

Each of screw mechanisms 6, 7, 8, 9 contains a stator and a rotor arranged thereinside; for the screw mechanism 6—a stator 10 and a rotor 11; for the mechanism 7—a stator 12 and a rotor 13; for the mechanism 8—a stator 14 and a rotor 15; for the mechanism 9—a stator 16 and a rotor 17.

The stators 10, 12, 14 and 16 of the actuating mechanism 1 and the bearing unit 2 are connected to each other by means of thread bushings 18 and have a common central axis 00 coinciding with the axis of the screw motor. The axes of rotors 11, 13, 15 and 17 are offset relative to this common axis 00 by the amount of eccentricity "e". The rotor 17 is connected to a shaft 19 of the bearing unit 2 with the aid of a flexible shaft 20. The axis of the shaft 19 also coincides with the axis 00. A rock-breaking tool (not shown in FIG. 1*a*, 1*a) is secured to the output end of the shaft 19**.

In each screw mechanism 6, 7, 8 and 9 the interacting rotors 11, 13, 15 and 17 the stators 10, 12, 14 and 16 corresponding thereto form working chambers A dividing the inner cavities of the screw mechanisms 6, 7, 8 and 9 into the cavities of high and low pressure.

The rotors 11 and 13, 13 and 15, 15 and 17 are interconnected by means of flexible shafts 21, 22 and 23, respectively, owing to which axial force from one rotor is transmitted to another (from 11, 13 and 15 to 13, 15 and 17, respectively), as well as the greater portion of the torque is transmitted. The connection of the rotors 11, 13, 15, 17 with the flexible shafts 21, 22, 23 is effected in the form of smooth tapered surfaces 24.

Besides, the rotors 11 and 13, 13 and 15, 15 and 17 are interconnected by means of guide units 25 to ensure a symmetrical displacement of their axes. They also transmit a certain remaining portion of the torque. The axes of the rotors 11, 13, 15 and 17 displace with respect to one another around the circumference of radius "e" equalling the amount of the eccentricity of the screw mechanisms, with the centre coinciding with the central axis 00. In the given variant the guide units 25 are made in the form of cranks 26, 27 and 28 whose working surfaces 29 and 30 are arranged in the respective rotors 11, 13, 15 and 17 by means of bearings 31 and 32, thereby ensuring the rotation of the cranks 26, 27, 28 relative to the rotors 11, 13, 15, 17 with a simultaneous transmission of certain part of the torque.

The structural variant, wherein the crank 26 is arranged inside the flexible shaft 21 and the rotors 11 and 13 are interconnected via the flexible shaft 21 along the smooth tapered surfaces 24, to transmit the axial force torque and ensures arrangement of the axes of the rotors 11 and 13 relative to the common central axis 00 of the stators 10 and 12, the arrangement being preset by the crank 26.

The preset arrangement of the axes of the rotors 15 and 17 with respect to the common central axis 00 of the stators 14 and 16 is ensured in a similar way with the aid of a crank 28 mounted inside the flexible shaft 23.

Thus, the axes of the rotors 11, 13, 15 and 17 of the screw mechanisms 6, 7, 8 and 9 are symmetrically oriented in the modules 4 and 5, respectively.

The modules 4, 5 proper are also symmetrically oriented relative to each other by means of a similar guide unit 25 of the crank 27 mounted between the rotors 13 and 15 and arranged inside the flexible shaft 22 which is also connected to the rotors 13 and 15 along the smooth tapered surfaces 24.

In this case the central angle of the symmetrical location of the axes of the rotors 11, 13 and 15, 17 of the screw mechanisms 6, 7 and 8, 9 in the modules 4, 5, respectively, being away from the central axis 00 by the amount of eccentricity "e", depends on the basis of the total amount of the screw mechanisms in each individual module. The angle of a symmetrical displacement of the modules 4 and 5 proper in the block 3 also depends on the number of modules in the block and is determined by the arrangement of the axes of corresponding extreme rotors (11 and 15 or 13 and 17).

Figure 2:
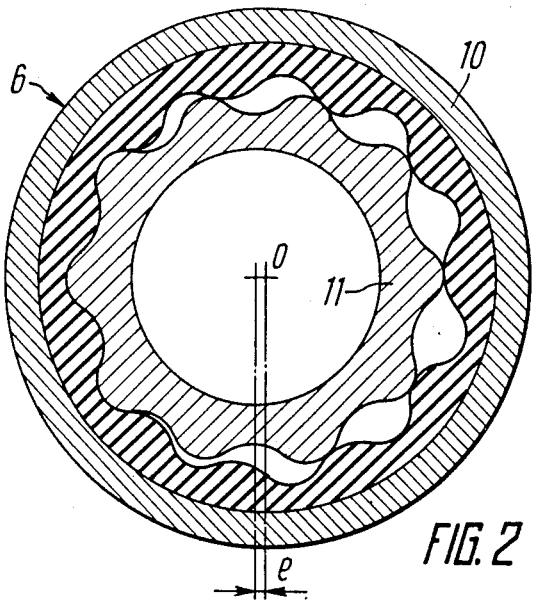
FIG. 2 is the cross section taken along II—II as in FIG. 1.
Figure 3:
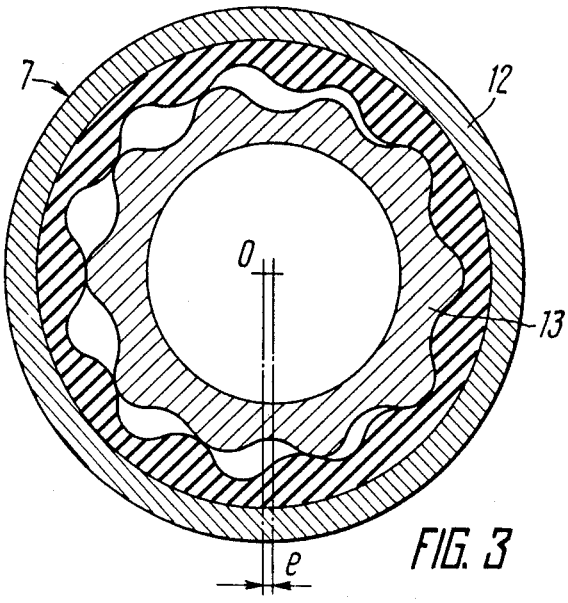
FIG. 3 is the cross section taken along III—III as in FIG. 1.

As is clear from the consideration of the cross sections shown in FIGS. 2 and 3, the axes of the rotors 11 and 13 of the preceding screw mechanism 6 and subsequent screw mechanisms 7 are displaced with respect to the common central axis 00 of the module 4 by the amount of eccentricity "e" and occupy a diametrically opposite symmetrical position.

Figure 4:
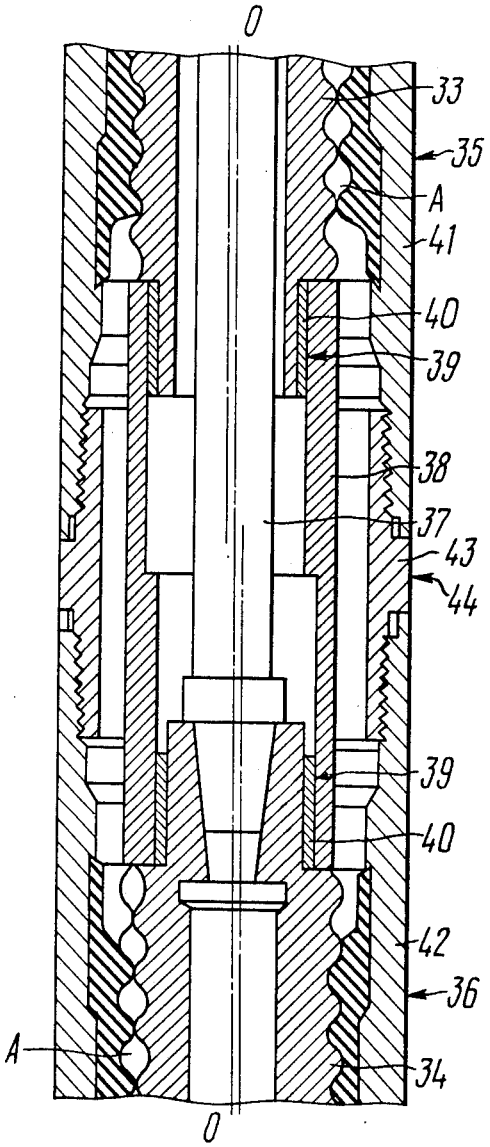
FIG. 4 is a variant of the connection of rotors in the screw mechanisms.

FIG. 4 shows a structural variant of connecting the rotors 33 and 34 of the two consecutively arranged screw mechanisms 35 and 36. In the given variant the flexible shaft 37 is disposed inside the crank 38. Like in the structure outlined above, the working surfaces 39 of the crank 38 are arranged in the bearings 40 at the end portions of the connected rotors 33 and 34 with the possibility of rotation. Stators 41 and 42 of the screw mechanisms 35 and 36 are connected to each other by a thread bushing 43 and together with the rotors 33 and 34 arranged inside form a module 44.

Figure 5:
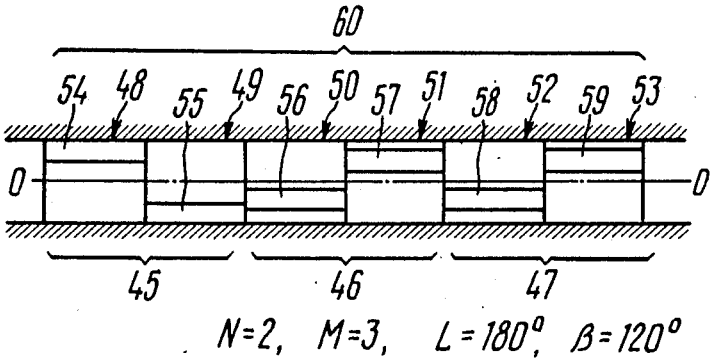
FIG. 5 is a diagram of the block of the screw machine, consisting of three modules, each comprising two consecutively arranged screw mechanisms.

The diagram of the screw machine shown in FIG. 5 comprises three modules 45, 46 and 47, each consisting of two screw mechanisms, namely, 48 and 49, 50 and 51, 52 and 53, respectively. The connection of rotors 54 and 55, 56 and 57, 58 and 59 of said screw mechanisms 48, 49, 50, 51, 52, 53 and their orientation, as well as the connection of rotors 54, 55, 56, 57, 58, 59 of the adjacent modules 45, 46, 47 are effected by means of the flexible shafts 20, 21, 22, 23 and the guide units 25 according to one of the variants outlined hereinabove.

Figure 6:
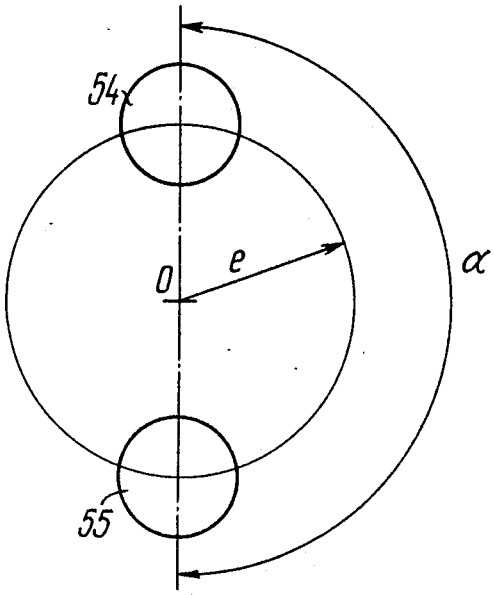
FIG. 6 is a diagram of the arrangement of rotors in the modules of the screw machine as in FIG. 5.

A symmetrical orientation of the axes of the rotors 54, 55, 56, 57, 58, 59 in each individual module 45, 46, 47 is attained by their consecutive displacement relative to one another through an angle $\alpha=180°$, because each module 45, 46, 47 contains two screw mechanisms 48, 49, 50, 51, 52, 53 (FIG. 6).

Figure 7:
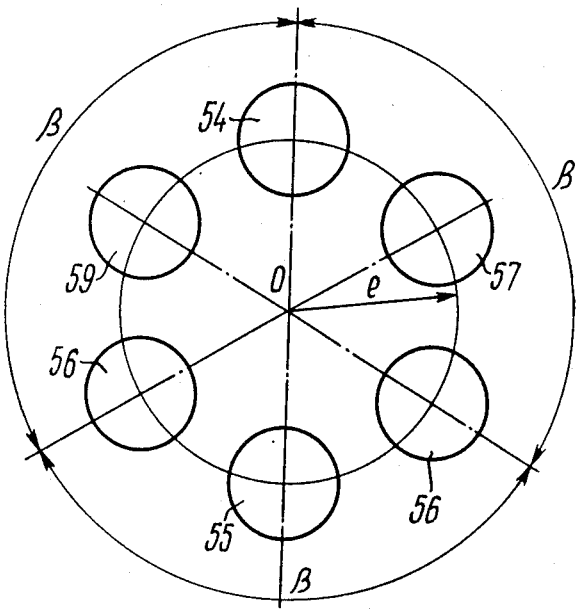
FIG. 7 is a diagram of the rotors in the block of the screw machine as in FIG. 5.

A symmetrical orientation of the modules 45, 46 and 47 proper (FIG. 7), which equals three in a block 60, is attained by displacing the axis of the rotor 56 of the screw mechanism 50 of the module 46 relative to the axis of the rotors 54 of the screw mechanism 48 of the module through an angle $\beta=120°$, because the number of modules 45, 46, 47 in the block 60 is three. The axis of the rotor 58 of the screw mechanisms 52 of the module 47 is displaced analogously and in the same direction relative to the axis of the rotor 56 of the screw mechanism 50 of the module 46. The axes of the rotors 54, 55, 56, 57, 58, 59 of the screw mechanisms 48, 49, 50, 51, 52, 53 are displaced around the circumference of radius "e" equalling the amount of eccentricity of the screw mechanisms 48, 49, 50, 51, 52, 53 identical for all mechanisms 48, 49, 50, 51, 52, 53.

Figure 8:
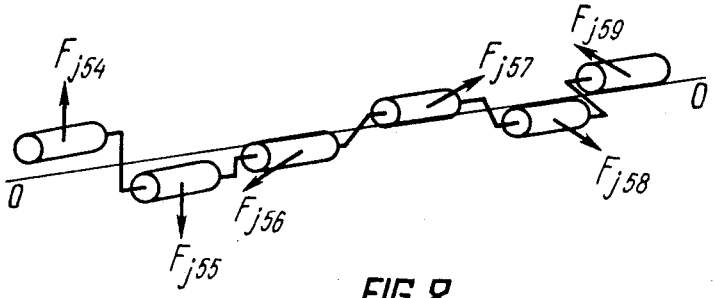
FIG. 8 is a diagram of the action of the forces of inertia in the screw machine, as in FIG. 5.

FIG. 8 shows the diagram of the action of the forces of inertia in the screw machine. The values of the forces of inertia $F_{j54}$, and $F_{j55}$, $F_{j56}$ and $F_{j57}$, $F_{j58}$ and $F_{j59}$ are equal and are also opposite in direction in pairs which ensures a complete balancing of not only the forces of inertia, but also the moments thereof. This is achieved by arranging the axes of the rotors 54, 55, 56, 57, 58 and 59 symmetrically with respect to the central axis 00 of the screw machine, and making the distances between the axes of the rotors 54 and 55, 56 and 57, 58 and 59 equal.

Figure 9:
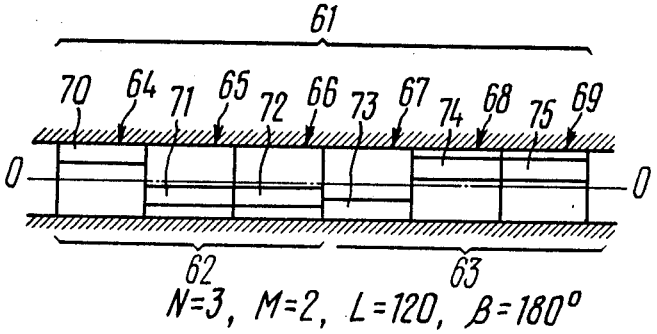
FIG. 9 is a diagram of the block of the screw machine consisting of two modules, each comprising threee consecutively arranged screw mechanisms.
Figure 10:
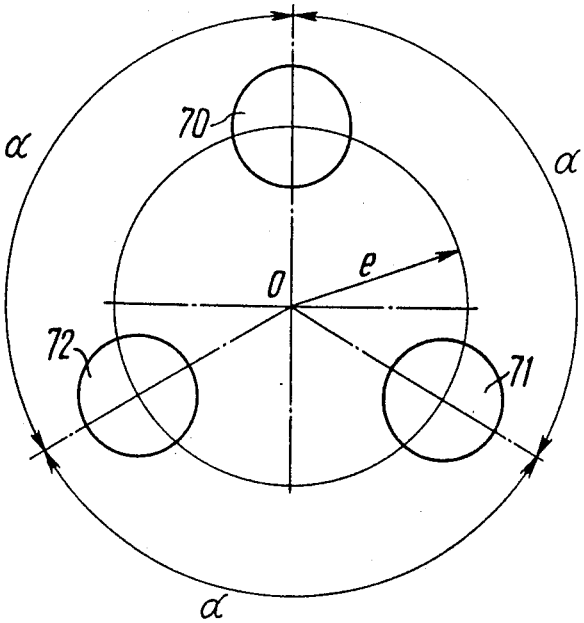
FIG. 10 is a diagram of the arrangement of rotors in the screw machine module as in FIG. 9.

A block 61 of the screw machine (FIG. 9) comprises two modules 62 and 63, each consisting of three screw mechanisms 64, 65, 66, 67, 68, 69, respectively. Inside the module 62 (FIG. 10) the axes of rotors 70, 71 and 72 of the screw mechanisms 64, 65 and 66 are consecutively displaced with respect to one another through an angle $\alpha=120°$, and therefore, the distance between the axes of the rotors 70, 71 and 72 are the same. The axes of rotors 73, 74 and 75 of the screw 67, 68 and 69 are displaced in the module 63 in an analogous manner.

Figure 11:
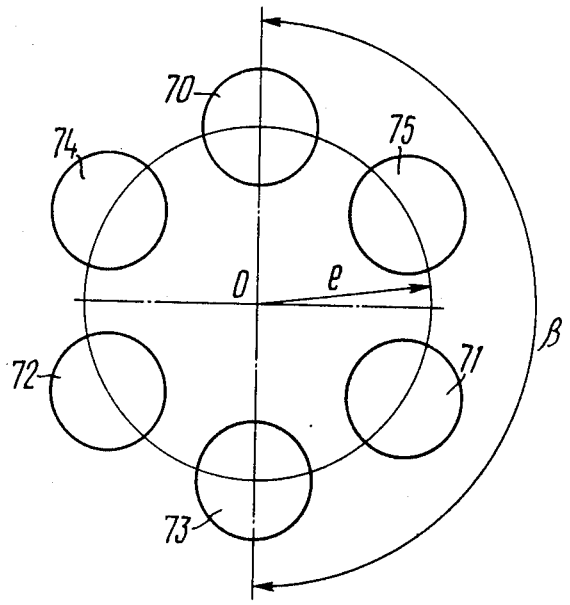
FIG. 11 is a diagram of the arrangement of the rotors in the block of the screw machine as in FIG. 9.

The modules 62 and 63 proper (FIG. 11) are oriented to each other so that the angle between the axes of the rotor 70 of the screw mechanisms 64 in the module 62 and the rotor 73 of the screw mechanism 67 in the module 63 is $\beta=180°$.

Figure 12:
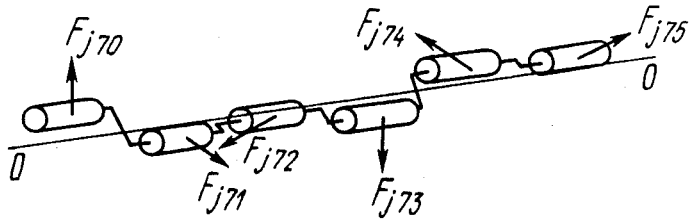
FIG. 12 is a diagram of the action of the forces of inertia in the screw machine as in FIG. 9.

The axes of the rotors 70, 71 and 72 displace symmetrically as in the variant described hereinabove along the circumference of radious "e", equalling the value of eccentricity of the screw mechanisms 64, 65, 66, 67, 68, 69 which is the same for all mechanisms. The centre of this circumference coincides with the central axis 00 of the screw machine and all screw mechanisms 64, 65, 66, 67, 68, 69. The diagram of action of the forces of inertia in the screw machine under consideration is shown in FIG. 12. In value determined by the mass of the rotors 70, 71, 72, 73, 74 and 75, they are equal. In each separate module 62, 63 the forces of inertia ($F_{j70}$, $F_{j71}$, $F_{j72}$ in the module 62 and $F_{j73}$, $F_{j74}$ and $F_{j75}$ in the module 63) are completely balanced, because their sum is zero. Also completely balanced are the moments of the forces of inertia owing to the fact that the axes of the rotors 70, 71, 72, 73, 74 and 75 are arranged symmetrically relative to the central axis 00 of the screw machine, and the distances between the axes of the rotors 70, 71 and 72 in the module 62 and rotors 73, 74 and 75 in the module 63 are equal.

Figure 13:
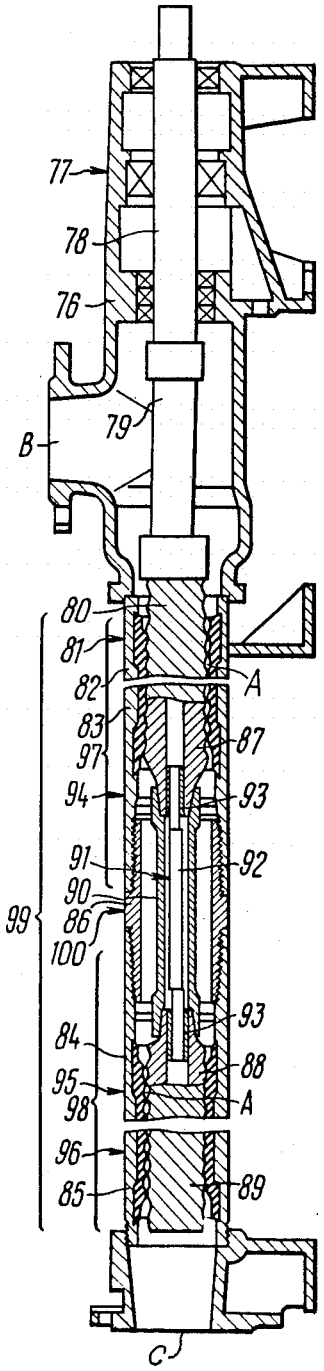
FIG. 13 is the general view of the screw machine used as a pump, longitudinal section.

FIG. 13 shows the screw machine according to the invention, which is used as a pump. Arranged in a housing of the pump is a bearing unit 77 and a drive shaft 78 which via an articulated joint 79 is connected to a rotor 80 of a screw mechanism 81. The rotor 80 is disposed inside a stator 82 which is rigidly connected to the housing 76 of the pump. Stators 82, 83, 84 and 85 are connected coaxially to one another with the aid of thread bushings 86. To ensure the transmission of the axial hydraulic load and the torque, as well as to ensure the preset displacement of the axes of the rotors 80, 87, 88 and 89, the latter are connected to one another according to one of the aforelisted variants, namely, with the aid of flexible shafts 90 and guide units 91 made in the form of a crank 92. The guide units 91 are arranged in respective rotors 80, 87, 88, 89 by means of bearings 93 with the possibility of rotation.

The stators 82, 83, 84 and 85 and the rotors 80, 87, 88 and 89 respectively disposed therein, form the screw mechanisms 81, 94, 95 and 96 assembled in pairs in modules 97 and 98 which in the given variant form only one block 99 of an actuating mechanism 100.

The pump has an input cavity B and output cavity C through which a working liquid or another fluid medium is discharged.

Figure 14:
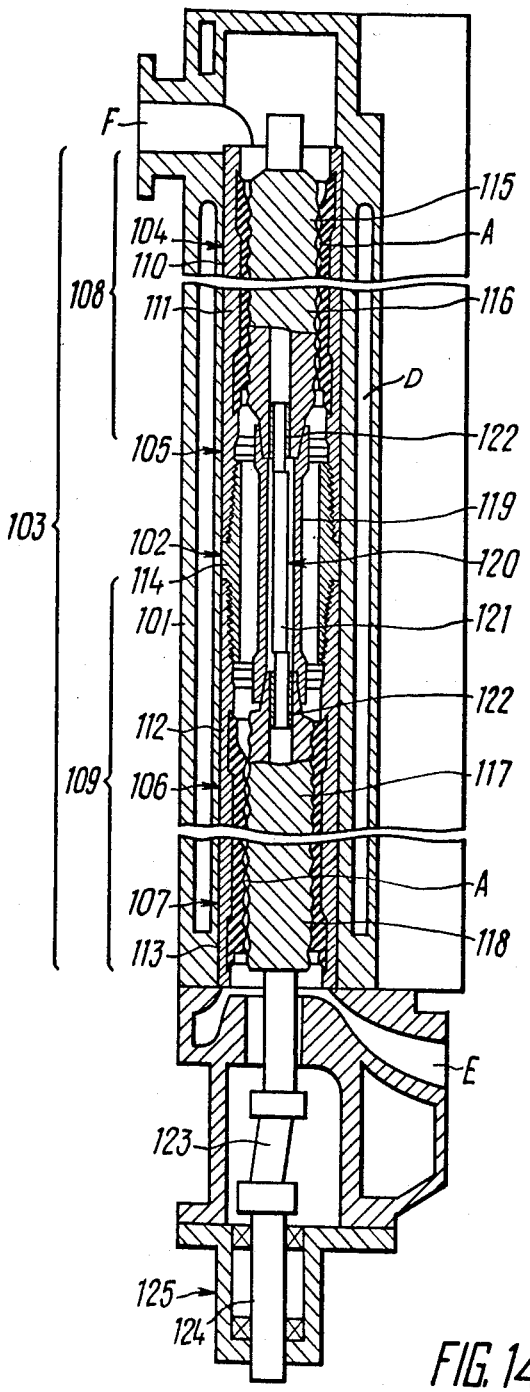
FIG. 14 is the general view of the screw machine used as a compressor, longitudinal section.

The screw machine shown in FIG. 14 is used as a compressor, in the body 101 of the compressor there is disposed an actuating mechanism 102 including a block 103 of screw mechanisms 104, 105, 106 and 107. The screw mechanisms 104 and 105, 106 and 107 are united in pairs into blocks 108 and 109, respectively. Stators 110, 111, 112 and 113 of the screw mechanisms 104, 105, 106 and 107 are coaxially connected to each other by means of thread bushings 114. Rotors 115, 116, 117 and 118 of these screw mechanisms 104, 105, 106, 107 are connected to one another according to one of the diagrams outlined hereinabove by means of flexible shafts 119 and guide units 120 made in the form of cranks 121 with the aim of ensuring the transmission of the axial hydraulic load and the torque, as well as providing a preset displacement of the axes of said rotors 115, 116, 117 and 118. A crank 121 is arranged in respective rotors 115, 116, 117, 118 by means of bearings 112 with the possibility of rotation.

The extreme rotor 118 of the screw mechanism 107 is rigidly connected to an articulated joint 123, and that one—to a drive shaft 124. The articulated joint 123 and the drive shaft 124 are disposed in a bearing unit 125 rigidly linked with the housing 101 inside which there are arranged cooling cavities D. The compressor has an input cavity E and an output cavity F through which gas medium is supplied to and discharged.

The screw machine in the variant of embodiment thereof is a downhole motor for drilling wells operates as follows.

Figure 1A:
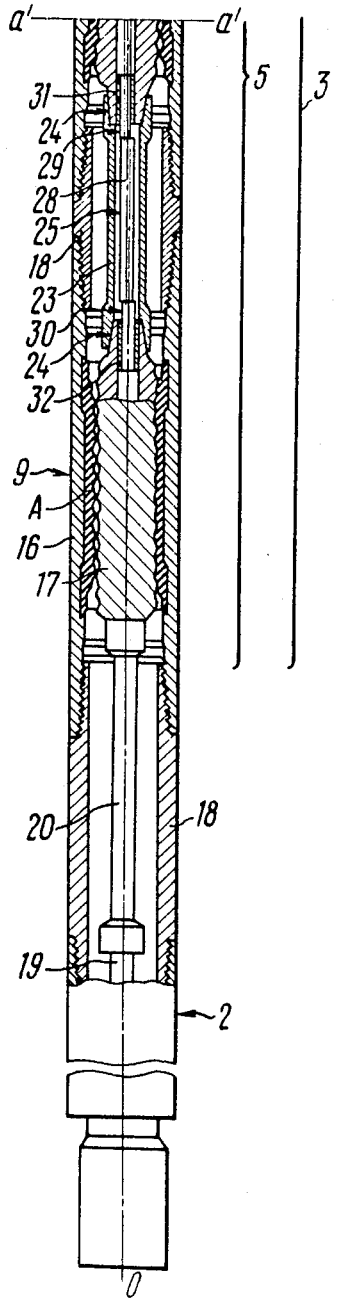

From the drill pipes (not shown in FIG. 1) working fluid is fed to the working chambers A of the first screw mechanism 6. Under action of a pressure drop an active torque develops on the rotor 11 and the latter starts rotating. From the rotor 11 rotation is consecutively transmitted via the flexible shafts 21, 22 and 23 to the rotors 13, 15 and 17 and further to the bearing unit 2 unit 2 and then to the rock-breaking tool (not shown). The torques arising under the action of the pressure drop on the rotors 11, 13, 15 and 17 are summed up and are also transmitted via the shaft 19 of the bearing unit 2 to the rock-breaking tool.

Having passed the working chambers A of the screw mechanism 6, the working fluid enters the working chambers A of the screw mechanism 7. The pressure drop occurring in the working chambers A of this screw mechanism 7 creates an additional torque in the rotor 13. Thus, the working fluid consecutively passes through the working chambers A of all screw mechanisms 8, 9 and via the bearing unit 2 to the rock-breaking tool through which it gets to the well bottom.

The operating principle of the screw machine shown in FIGS. 13 and 14 has the only distinction which consists in that the rotors 80, 87, 88 and 89, 115, 116, 117 and 118 are driven by means of a motor (not shown in the drawing) via the drive shafts 78, 124, and the working fluid (gas medium) is pumped over from the cavity B (E) via the working chambers A of the screw machanisms 81, 94, 95, 96, 104, 105, 106, 107 to the cavities C (F).

INDUSTRIAL APPLICABILITY

The present invention can most effectively be used as a drive for a rock-breaking tool in drilling oil and gas wells.

The invention can be used also as a downhole pumping unit for extracting water, oil or other mineral resources which are pumped over in a liquid form.

Besides, the invention can be used in developing reliable pumping units or packaged compressors pumping over liquid, gaseous or mixed agents.

We claim:

1. A screw machine which comprises consecutively mounted screw mechanisms comprising a plurality of coaxially arranged stators and rotors disposed therein, the axis of the rotor is offset relative to the axis of the stator within which it is disposed, by the amount of eccentricity, "e", of the screw mechanism, wherein all of the stators have a common axis and wherein the screw mechanisms are grouped into modules each comprising at least two mechanisms and the modules are grouped into blocks each comprising at least two modules, the axes of the rotors of the screw mechanisms forming the modules and axes of the rotors of the screw mechanisms of the modules forming the blocks are arranged symmetrically with respect to the common axis about a circumference of radius "e" from said common axis, and the distance between axes of the rotors in adjacent screw mechanisms in each module are the same.

2. A screw machine according to claim 1 wherein a guide unit is provided between the rotors of the screw mechanism in each module and between the screw mechanism in each block.

3. A screw mechanism of claim 2, wherein the guide unit is in the form of a bearing mounted crank connecting adjacent rotors, the axis of the bearings coinciding with the axis of a respective rotor.

* * * * *